US008337181B2

(12) United States Patent
Orban

(10) Patent No.: US 8,337,181 B2
(45) Date of Patent: Dec. 25, 2012

(54) ROTARY PUMP WITH DEFORMABLE ROLLERS

(75) Inventor: Jacques Orban, Moscow (RU)

(73) Assignee: Schlumberger Technology Corporation, Sugar Land, TX (US)

( * ) Notice: Subject to any disclaimer, the term of this patent is extended or adjusted under 35 U.S.C. 154(b) by 875 days.

(21) Appl. No.: 12/282,383

(22) PCT Filed: Mar. 16, 2007

(86) PCT No.: PCT/RU2007/000132

§ 371 (c)(1),
(2), (4) Date: Feb. 17, 2009

(87) PCT Pub. No.: WO2007/108721

PCT Pub. Date: Sep. 27, 2007

(65) Prior Publication Data

US 2009/0220367 A1 Sep. 3, 2009

(30) Foreign Application Priority Data

Mar. 17, 2006 (RU) ..... 2006108511

(51) Int. Cl.
*F01C 5/00* (2006.01)
*F04C 5/00* (2006.01)

(52) U.S. Cl. ..... 418/45; 418/56; 418/153; 418/156; 418/194

(58) Field of Classification Search ..... 418/153, 418/156, 45, 56, 194
See application file for complete search history.

(56) References Cited

U.S. PATENT DOCUMENTS

| | | | | | |
|---|---|---|---|---|---|
| 169,703 | A | * | 11/1875 | Huber | 418/45 |
| 1,164,546 | A | * | 12/1915 | Neuland | 418/194 |
| 1,268,771 | A | * | 6/1918 | Randolph | 418/194 |
| 2,818,707 | A | | 1/1958 | Sturm | |
| 2,988,003 | A | | 6/1961 | Schmied | |
| 3,203,356 | A | | 8/1965 | Jepsen | |
| 3,470,948 | A | * | 10/1969 | Korsch | 418/45 |
| 3,905,726 | A | | 9/1975 | Gondek | |
| 3,946,641 | A | * | 3/1976 | Hirmann | 91/491 |
| 4,138,206 | A | * | 2/1979 | Zinevich et al. | 418/153 |
| 7,150,611 | B2 | * | 12/2006 | Perna | 418/194 |
| 7,644,695 | B2 | * | 1/2010 | Chadwick | 418/196 |

FOREIGN PATENT DOCUMENTS

| | | | | |
|---|---|---|---|---|
| DE | 3130670 | A1 | | 2/1983 |
| DE | 3333873 | A1 | * | 4/1984 |
| JP | 63105201 | A | * | 5/1988 |
| JP | 06307360 | A | * | 11/1994 |
| SU | 1551913 | A1 | | 3/1990 |

* cited by examiner

*Primary Examiner* — Mary A Davis
(74) *Attorney, Agent, or Firm* — Jim Patterson

(57) ABSTRACT

The claimed invention relates to rotary pumps. The claimed rotary pump comprises: an hollow housing having a side wall and end-face walls; a shaft rotatably positioned in the housing essentially in parallel with the side wall, the distance between the housing side wall and the shaft is variable; deformable rollers that are arranged and adapted to move, when the shaft rotates, between the housing side-wall and the shaft, while moving their deformation being maximal in the region of the minimal distance between the housing side-wall and the shaft; and sealed cavities, each of which cavities being defined by two contiguous rollers, the housing's side wall and end-face walls; the sealed cavities being adapted to communicate with the suction port as their volume increases, and communicate with the delivery port as their volume decreases. The technical result: an enhanced delivery capacity—with simultaneous decrease in dimensions and mass; an improved cost-effectiveness, extended longevity and more simple operation.

11 Claims, 6 Drawing Sheets

ROTARY PUMP WITH DEFORMABLE ROLLERS

Figure 1:
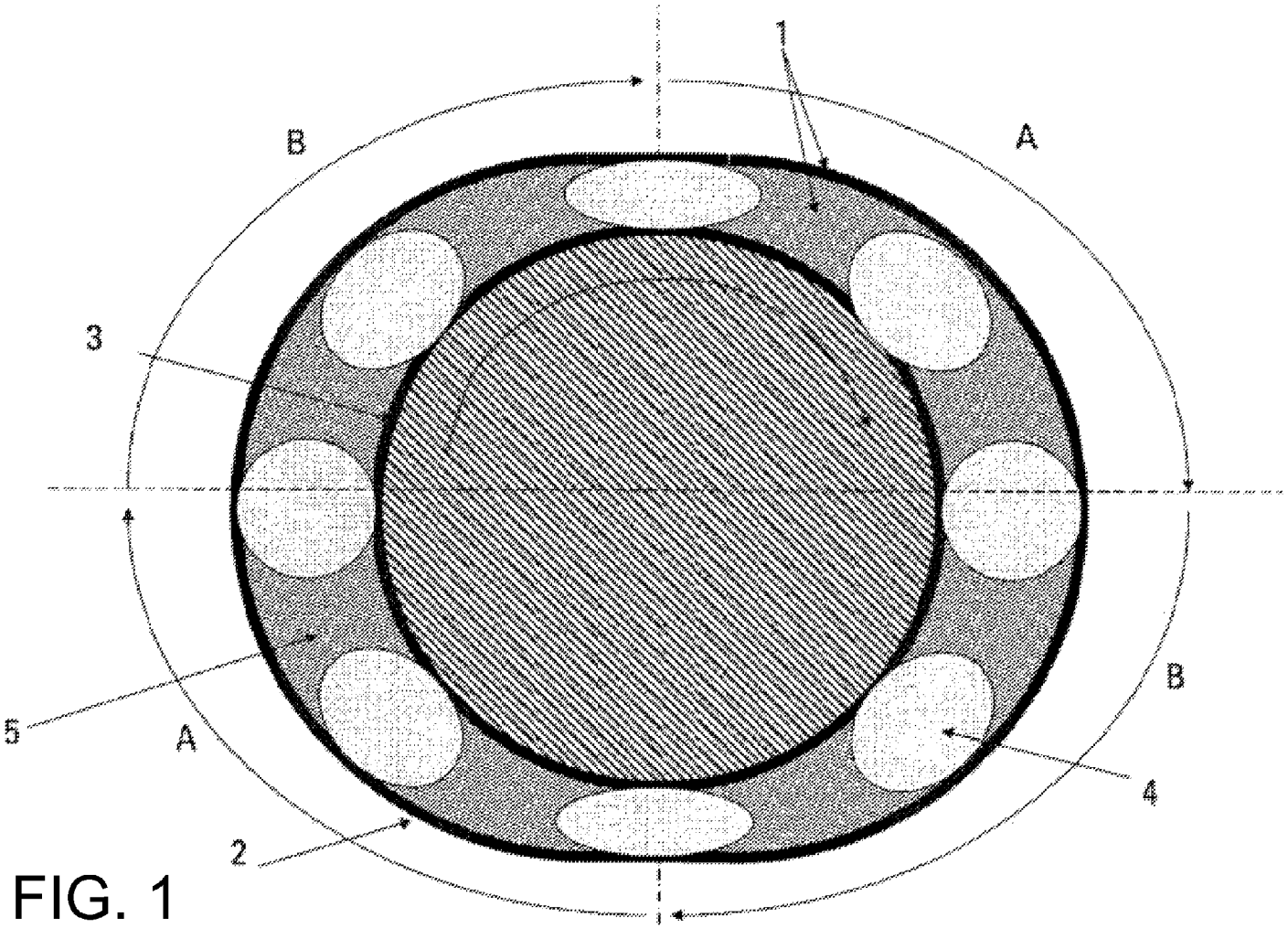

The invention relates to rotary pumps. In particular, the invention relates to a rotary pump having deformable rollers.

In the oil producing industry, for the mechanized extraction of petroleum the electric immersion pumps are extensively used. These pumps have rather various designs. Said electric immersion pumps basically consist of a pumping section, electric motor and an oil compensating chamber. Operation of the pumping section is based on the use of an high-velocity rotating centrifugal or rotary-axial impeller and a guiding device (diffuser) that constitute a pump stage. A disadvantage of these pumps is a low delivery pressure of a pump stage, which causes the necessity to use a rather large number of stages. This circumstance entails a series of additional problems. Thus, an increased number of stages is followed by growth of length and mass of an electric immersion pump. A considerable length makes the operations of mounting of a pump on a derrick difficult. A greater mass of a pump brings about a persistent moment of inertia when a pump is started, which may result either in breaking of a pump itself, or of a tubing, to which this pump is attached. The factor of a greater mass of a pump becomes particularly important in greater depth of a well, and when a pump is tuned on/off frequently. To restrict these impairing effects, quite expensive devices to control rpms of a pump have to be used, which increases the accompanying capitalized expenses. Another drawback of the electric immersion pumps is a high wear of its parts due to an high rotational speed. Still another drawback of the electric immersion pumps is their inefficient operation with a gas. Besides, there is a risk of failure of the motor due to a high voltage and strong current in the oil that may contain water.

The way to resolve the problem of a low delivery pressure and, consequently, that of a lengthy and weighty pump is seen in use of a positive displacement rotary pump, for example, a helical rotor pump, that manages well the viscous, in particular—heavy petroleum. But the known positive-displacement rotary pumps are not suitable. for their use in oil wells due to their constructional parameters. Thus, the piston rotary pumps have the dimensions that do not allow them to be positioned within a well. Some known rotary pumps have a suction channel and delivery channel, which channels extend transversely to the impeller axis. Therefore in these pumps possible is only the lateral connection of the pipe where through a pumped fluid is delivered, which circumstance makes the whole design too bulky to be used within a well. Further drawback of the rotary pumps consists in that they are limited by small feeds, and are not intended to operate with fluids containing hard particles. It should be noted that some types of the positive-displacement pumps, e.g.—the impeller pumps, have the problem of the wear of the pump working parts that slidingly contact with one another.

In view of the foregoing discussion, this invention is directed to development of a pump suitable for operation in wells and capable of pumping fluids, inclusive of those containing hard particles, and gases, and which pump will provide, with its minor dimensions, a strong delivery pressure, will be of an improved longevity, cost-effective and simple in its operation.

Said goal is to be attained by use of a rotary pump, including an hollow housing, comprising a side wall and end-face walls;

a shaft rotatably positioned within the housing, the distance between the side wall of the housing and the shaft being variable;

deformable rollers disposed and moveable, as the shaft rotates, between the housing side wall and the shaft while being subjected to maximum deformation in the region of the minimum distance between the housing side wall and the shaft; and sealed cavities, each of which cavities being defined by two contiguous rollers, the housing's side wall and end-face walls and the shaft; said sealed cavities communicating with the suction port—as their volume increases, and communicating with the delivery port as their volume decreases.

In this context, the "deformable" term denotes the roller's property of being resiliently compressed under the action of the compressive force, and of regaining its shape when said force ceases to act.

The "sealed cavity" term denotes the cavity that is capable of essentially communicating only with the suction port and delivery port, and essentially is not capable of communicating with the neighboring cavities or with environment of a given pump.

A rotary pump according to the invention provides a strong delivery pressure, thus not requiring a large number of stages to create a required degree of delivery. For this reason, this pump, as compared with those of prior art, has smaller dimensions and lesser mass, and allows an easier handling thereof, including an easier mounting/dismantling on a derrick.

The absence of gaps between the deformable rollers and shaft, and, respectively, the side wall and end-face walls permits to exclude any reverse flows in the pump, resulting in its enhanced capacity. Further, owing to the absence of gaps, pumping of gaseous mixtures becomes possible. The feature of deformability (resiliency) of the rollers allows avoid, or at least significantly reduce, the negative effect the hard (abrading) particles exert on the pump, such that the inventive pump can be used for pumping the gaseous and/or liquid mixtures having a large content of hard particles.

The deformable rollers perform the rolling motion with respect to the shaft and the housing side wall, so that the wear caused by friction (sliding) between the contacting surfaces is eliminated. Apart form that, for the reason that the extracted fluid is pumped by separate volumes, and not as the continuous flow, any fast rotational speeds are not needed, so that wear is further reduced. Thus, the pump according to the invention has an improved longevity.

The absence of high rotational speeds, and a low mass of the pump result in a lesser sluggishness thereof, which circumstance also positively influences its longevity.

In the claimed pump, depending on the operation conditions, cross-section of the housing can be of the ellipse shape, and the shaft may have circular cross-section, whereat the geometrical longitudinal axes of the housing and shaft coincide. The shaft may also have the elliptic cross-section, and in this case the housing may have both circular and elliptic cross-sections. Alternatively, the housing and shaft may have circular cross-section, the shaft being positioned off-centre relative to the housing. A person skilled in the art will appreciate that other versions of cross-section and/or disposition of the shaft with respect to the housing can be selected as well, which versions will allow the rollers move with capability of being deformed for suction and delivery of a fluid or gas.

In the inventive pump, during single turn of the rollers about the shaft, the sealed cavities may several times undergo an increase and decrease of their volume successively. In other words, a number of suction and a number of delivery regions may be provided for, thus permitting to enhance capacity of the inventive pump.

The suction port and/or delivery port can be implemented both in the side wall and the corresponding end-face wall of the housing. It is obvious that the suction port and delivery port can be displaced relative to one another to an extent that they will not be able to be within the same geometrical plane simultaneously. Or the suction port and/or delivery port may be implemented in the rotating shaft body. So, according to an embodiment of this invention, the shaft may have an essentially through cavity subdivided into separate chambers isolated from one another. Each one of the chambers accordingly defines the suction port and delivery port. Various combinations of the above-mentioned arrangements of the suction port and delivery port are also possible; in particular, one of said ports may be implemented in the shaft, and the other—in the body. A specific version for implementing said ports is to be selected by a person skilled in the art in view of a method of a contemplated operation of the pump so that to optimize its operation.

At least one end-face of the housing wall is removably coupled to the housing side wall. This arrangement ensures possibility of replacement of the worn rollers. Both end-face walls are preferably coupled detachably to the side wall, allowing their replacement due to the wear caused by sliding of the rollers' end-faces on the housing end-face walls. Such embodiment allows reduce the maintenance cost, for it is such inexpensive and simply produced pump part as the end-face wall, easily replaced, that is subjected to wear. Alternatively, the walls may be implemented integrally with the side wall, and the side wall itself can be defined by two detachable parts. In such case, manufacture and assembling of the claimed pump is simplified owing to a small number of detachable joints (only one). Said detachable joint can be in the form of a threaded, clamping, frictional or a similar joint.

The pump shaft can be driven by an electric or hydraulic motor. Use of an hydraulic motor is more preferable in cases of operation with the fluids containing a large amount of gas. An advantage of an hydraulic motor consists in that it supplies to inlet of the claimed rotary pump a portion of the degassed petroleum, oil, etc. Supply of this portion into a pump allows provide the complete filling thereof in the course of operation, to prevent a lower pressure therein and. exclude the accompanying release of gas bubbles that create the clearance volumes in the pump and reduce capacity of the pump.

The deformable rollers can be implemented using completely different methods. Thus the rollers can be made in the form of straight cylindrical rods of constant diameter, manufactured of resilient material. The rods can be the solid or hollow ones, to save a material used therefore. In case of specifically high loads, the rods can be made of a resilient material that is reinforced, for example, by glass fibre, carbon fibre, steel threads, etc., or the rods can comprise an hard rod (made of steel, etc.), coated by a resilient material layer. The rollers need not necessarily be in the form of cylindrical rods having constant diameter. In some cases, the shaft and/or housing (the side wall and/or end-face walls) can be advantageously designed such that cross-section of the sealed cavities will decrease in their longitudinal direction. In this arrangement, the minimum cross-section of the sealed cavity can exist both in the region located at the delivery port side, and in the region located at the suction port side. This design can be effected by implementing the tapered surfaces on the side wall and/or end-face walls of the housing and/or shaft or by similar means, for example—by the stepwise change of cross-section of the shaft and/or housing. In this case, cross-section of the rollers can vary lengthwise, for example—in the form of truncated cone. Otherwise the rollers can be implemented according to one of the previous methods described for a straight cylindrical rod.

A resilient material used for manufacture of the rollers, comprises any natural or synthetic material that is capable of withstanding a great number of resilient deformation cycles (compression/tension), its properties being preserved. Different types of rubber or similar materials can be considered for their use as such material.

The rollers should not slide along the surface. The reason, first, is that the wear caused by the sliding friction will be avoided if sliding is prevented. A roller is also subjected to the action exerted by a pressure drop on the part of a fluid in a cavity at each one of the roller sides. This pressure drop brings about the tangential force that is opposite to movement of a roller. For ensuring the proper movement of a roller, it is essentially important that a roller will have a sufficient friction on the shaft and housing. This friction will prevent crowding of the rollers on one and the same location, and should be provided by suitable means. Such means can comprise lugs on the shaft that interact with the rollers when the shaft rotates, end-face holders of the rollers, geared engagement of the rollers with the shaft and housing, and similar means, or their combinations.

Figure 2:
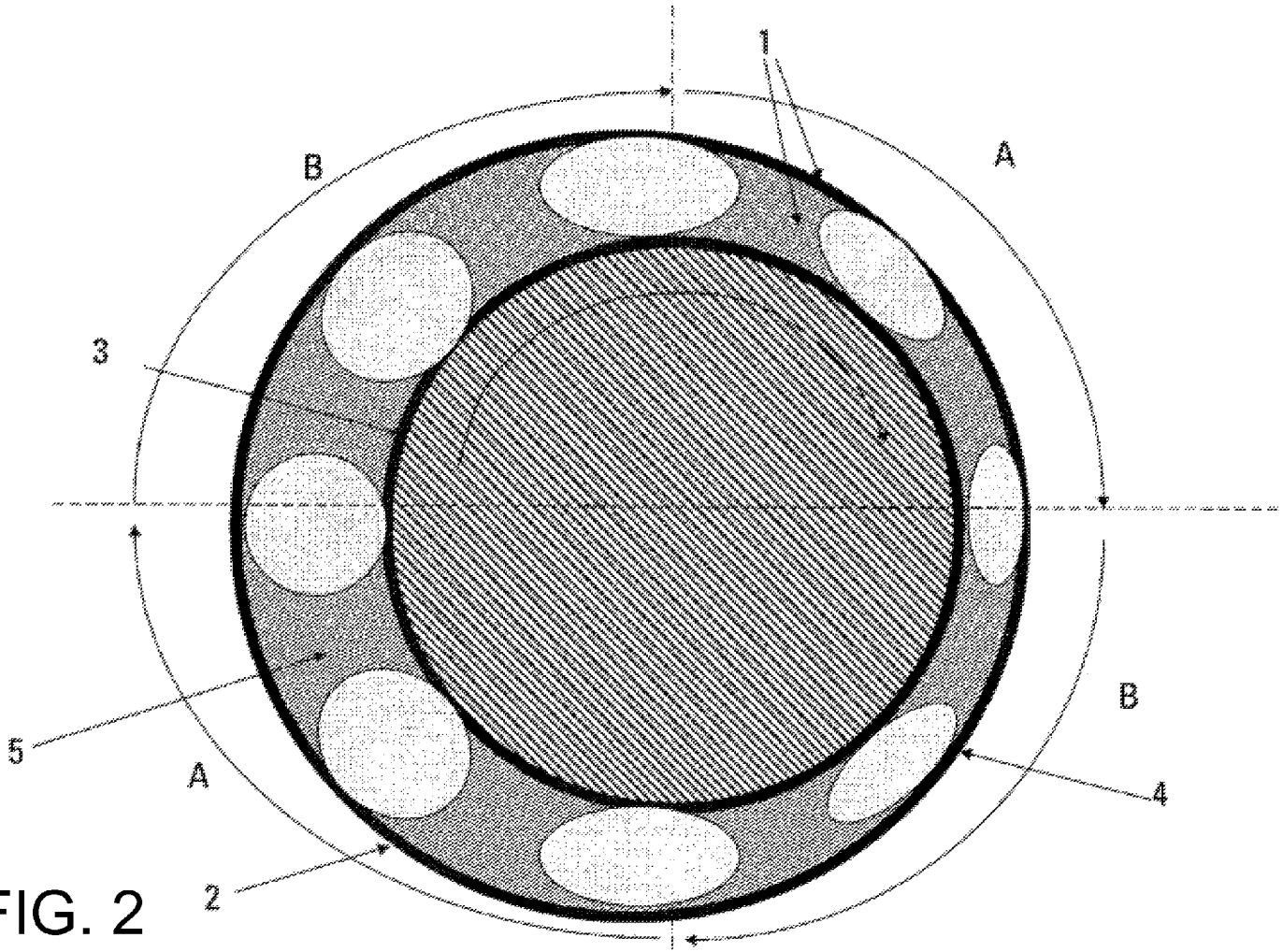
Figure 3:
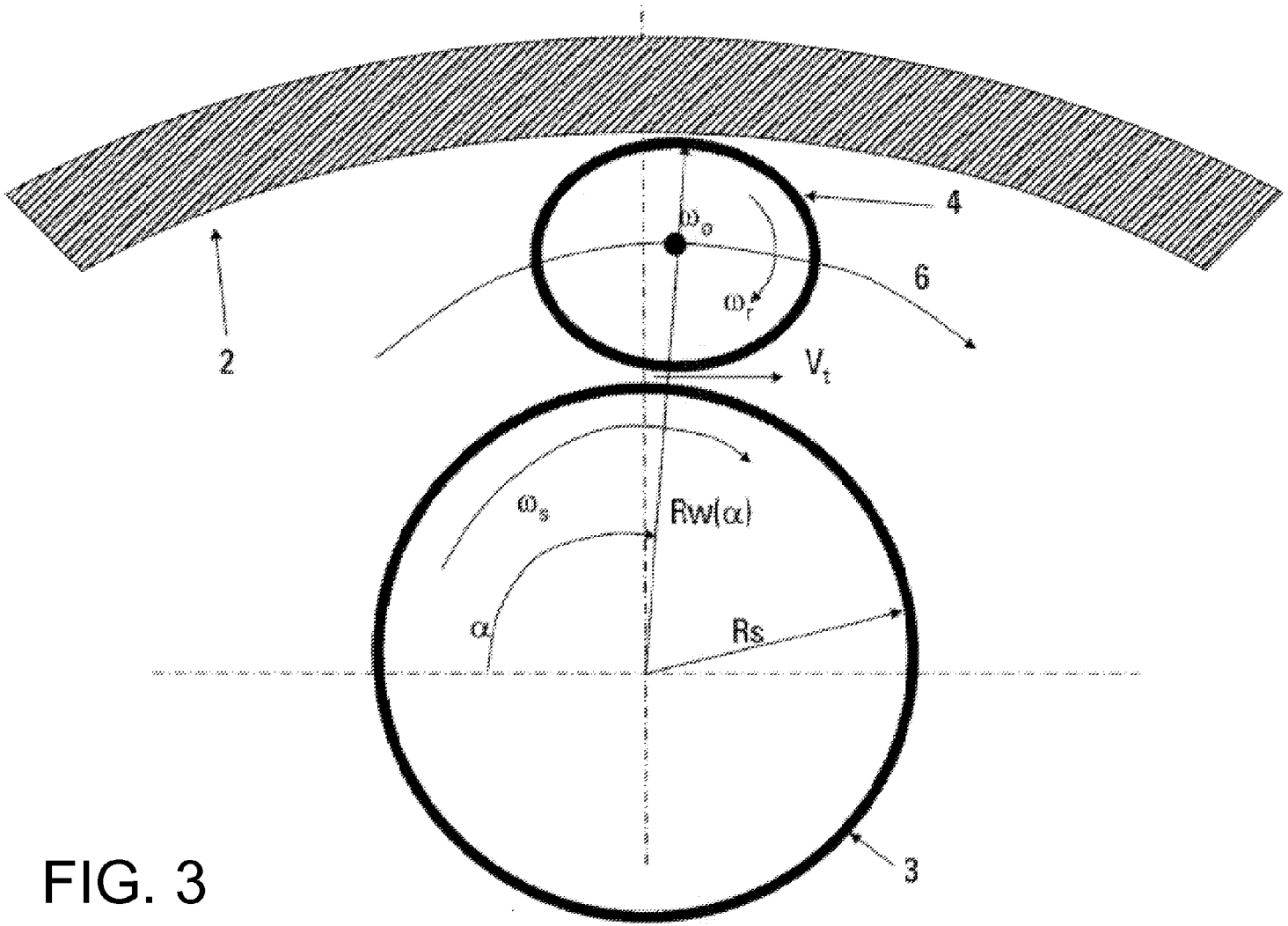
Figure 4:
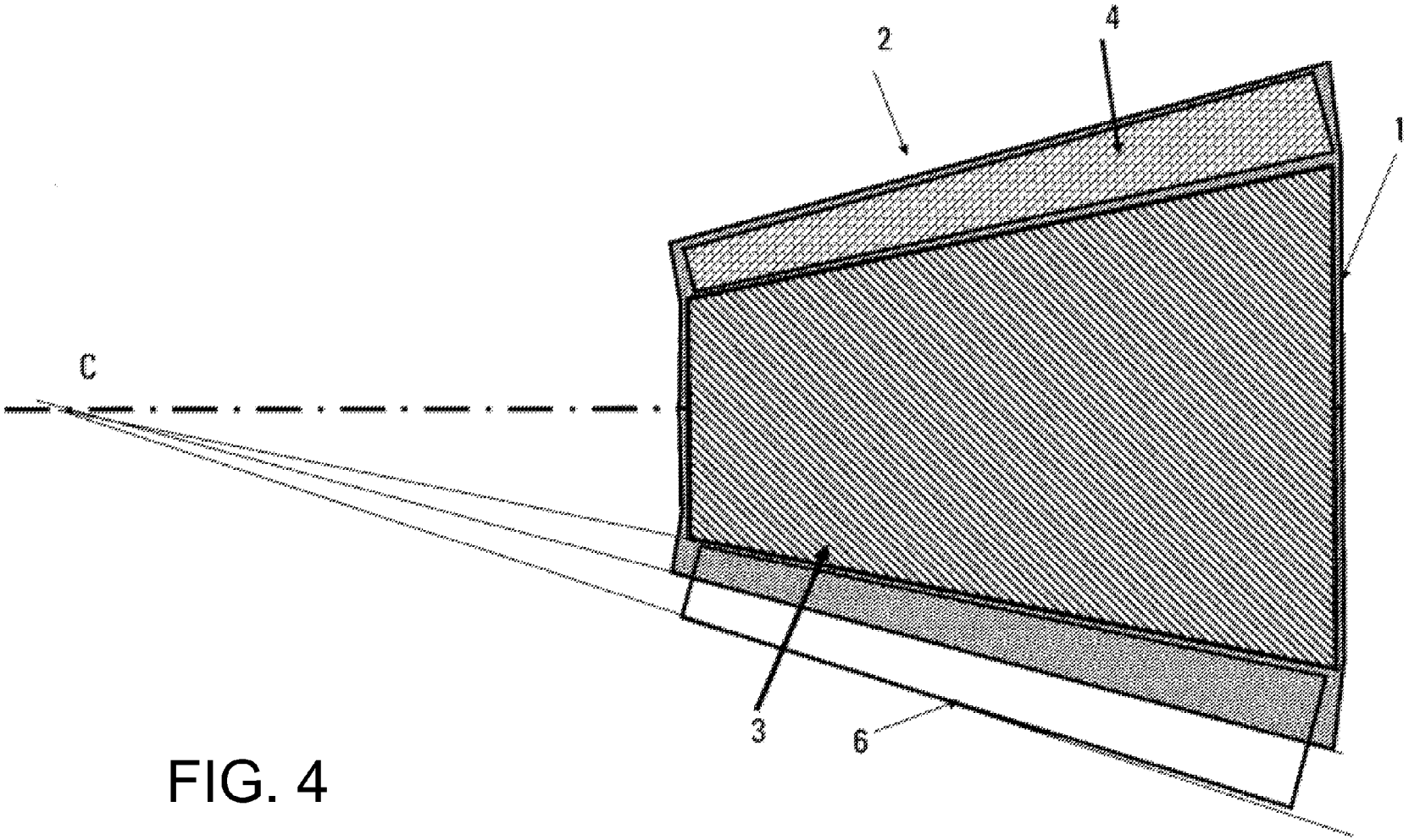
Figure 5:
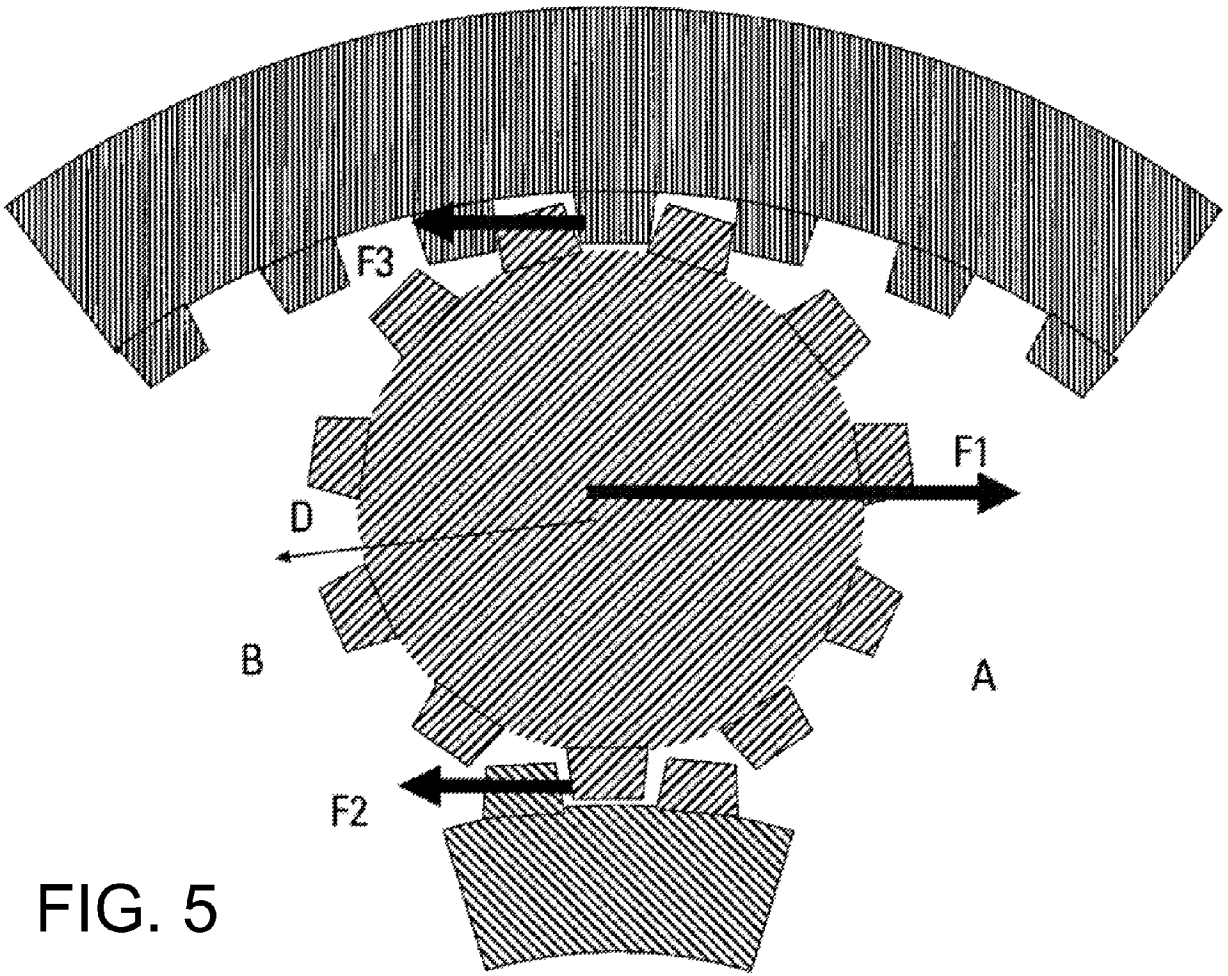
Figure 6:
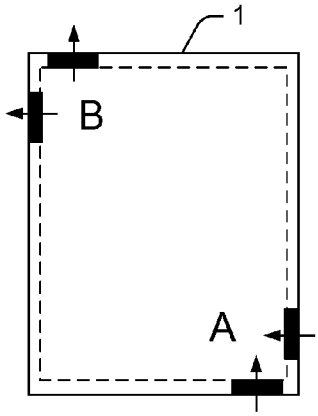
Figure 7:
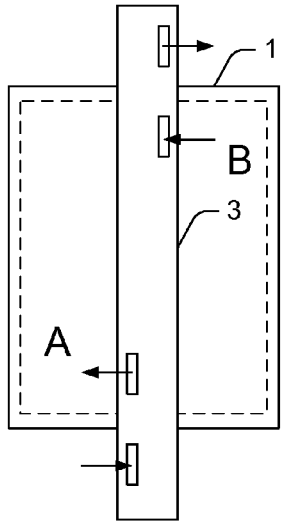
Figure 8:
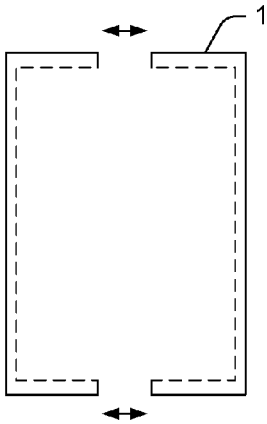
Figure 9:
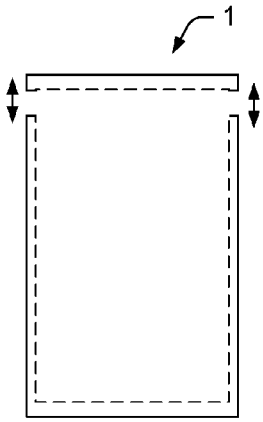
Figure 10:
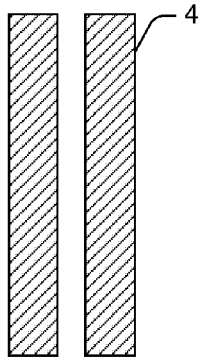

The invention further is described in more detail using the accompanying drawings that illustrate exemplary embodiments, wherein:

FIG. 1—cross-section of the inventive rotary pump, wherein the longitudinal geometric axes of the housing and shaft coincide;

FIG. 2—cross-section of the inventive rotary pump, wherein the shaft is positioned off-centre;

FIG. 3—speed vector of the shaft and rollers in this position;

FIG. 4—longitudinal section of the inventive rotary pump having a sealed chamber whose shape varies along its section;

FIG. 5—the pump design that provides the proper rolling without sliding;

FIG. 6—the suction port and/or delivery port implemented in a respective housing end-face wall and/or housing side-wall;

FIG. 7—the suction port and/or delivery port implemented in the rotating shaft;

FIG. 8—the housing end-face walls integral with the housing side wall, which is detachable;

FIG. 9—at least one housing end-face detachably coupled to the housing side wall; and FIG. 10—a roller implemented in the form of a hollow rod made of a resilient material.

The rotary pump according to the invention has tubular housing 1 defined by side wall 2, which wall in this embodiment has elliptic cross-section, and by end-face walls (not shown). Housing 1 accommodates rotatable shaft 3 driven by an hydraulic motor (not shown). Geometric longitudinal axes of housing 1 and shaft 3 coincide. Between side wall 2 of housing 1 and shaft 3 provided is the operating space. The operating space is comprised by alternating areas wherein width varies from the minimum value to the maximum value, and vice versa, and this embodiment provides two such areas of each one of the types. Area A of the operating space, wherein width varies from its maximum value to its minimum value, includes the suction region and fairs into the suction port provided in the end-face wall of housing 1. Area B of the operating space, where width varies from the maximum value to minimum value, includes the delivery region and fairs into the delivery port in other end-face wall of housing 1. The operating space accommodates deformable rollers 4 that contact with side wall 2, housing 1 and shaft 4, by which shaft they are caused to rotate. In this embodiment, rollers 4 are implemented in the form of solid cylindrical rods that extend along housing 1 and shaft 3, and their end-faces slidingly contact the end-face walls of housing 1. Thus, rollers 4 divide the operating space into separate longitudinal sealed cavities 5. A deformation degree of rollers 4 is determined by width of the operating space in their location. Thus, when the operating space has the minimum width, roller 4 has the maximum degree of its deformation; and when the operating space has the maximum width, its deformation is minimal. For the reason of variable degree of deformation of rollers 4, sealed cavities 5 defined by said rollers will have a variable volume, accordingly. As best seen in FIG. 1: volume of sealed cavities 5 in area A increases as the place of minimum deformation of roller 4 is approached; and volume of sealed cavities 5 in area B decreases as the sealed cavities approach the place of maximum deformation of roller 4.

The pump can be provided with means for retaining the roller, which means will allow revolving of the rollers around shaft 3 and side wall 2 of housing 1, and will prevent the rollers from being crowded in any region of the operating space. For example, such means may be implemented in the form of lugs on shaft 3 that interact with rollers 4. These means may also represent a thread cut on the rollers and engaging the thread on side wall 2 of housing 1 and/or shaft 3. It is obvious that a person skilled in the art will be able to devise other numerous versions of implementation of such means, which are beyond the scope of this invention and are not described or shown in detail here.

FIG. 2 shows an embodiment of the claimed rotary pump that is essentially identical to that of FIG. 1. The distinction is that housing 1 and shaft 3 have circular cross-section. Shaft 3 is disposed off-centre in housing 1.

FIG. 3 shows different speeds of various components of the pump. The roller centre describes the orbit of a variable radius:

$R_{orb}$ (α) is radius of the orbit at angle α

$$R_{orb}(\alpha)=(Rw(\alpha)-Rs)/2,$$

where Rw (α) is radius of side wall 2 at angle α

Rs is radius of shaft 3.

It should be noted that tangential speed of a roller is equal to that of the shaft, because there is no sliding at the point of contact between the shaft and roller. At the point of contact with the side wall, tangential speed is zero. It means that linear orbital speed of a roller is:

$$V_{orb}=V_t/2,$$

where $V_t$ is tangential speed on the shaft surface.

$$\omega_{orb}=V_{orb}/R_{orb}=\omega s(Rw(\alpha)+Rs) \quad (A)$$

where ωs is rotational speed of the shaft (rad/s)

$\omega_{orb}$ is angular orbital velocity (rad/s).

It should be appreciated that angular velocity of rotation as such for cylindrical rollers is:

$$\omega_r=\omega_{orb}(Rw(\alpha)2/(Rw(\alpha)-Rs)-1). \quad (B)$$

This formula shows that angular orbital velocity of a roller increases in the region where the lateral cavity is small. It means that the distance between two neighboring rollers must slightly increase in the converging region (delivery), while the distance between the rollers will be the least in the converging region (suction region). This effect should be properly taken into account when a roller is fitted into a pump.

FIG. 4 shows the embodiment of the claimed rotary pump, wherein the operating space between side wall 2 of housing 1 and shaft 3, together with variable cross-section, has variable longitudinal section. Rollers 4 in this embodiment have the shape of truncated cone. Geometrical axis of housing 1 here coincides with that of shaft 3. Vertexes of the cones must coincide. It can be seen that this geometrical criterion is sufficient to ensure that ratio of A and B is adjusted along the rigid conical roller. The compressible rollers are also the truncated cones: when they converge in the non-deformed state, then the cone vertex converges with two other cones at point C. It should be appreciated that the outer housing has the elliptic shape in the plane of perpendicular axis.

The rotary pump shown in FIG. 1 operates as follows. Shaft 3 is driven to rotation by an hydraulic motor. Rotation of shaft 3 causes rollers 4 to rotate about their own axis and around shaft 3. Roller 4 (the topmost one in FIG. 1), having the maximum degree of deformation, begins to move in the expanding area A of the operating space. In the course of this movement, a degree of deformation of this roller lessens. At the same time the roller following said roller (next roller) moves in the narrowing area B of the operating space, and degree of its deformation increases accordingly. As this simultaneous deformation of said first roller lessens and deformation of said second roller increases, volume of the sealed chamber defined by said rollers does not vary. Such constancy of volume of the sealed chamber is maintained until the second roller reaches the narrowest region of the operating space and, accordingly, acquires the maximum degree of deformation. At this moment, connection of the sealed chamber to the suction port occurs, and further movement of the first and second rollers takes place with lessening of degree of their deformation and growing of volume of the sealed chamber. Now the petroleum suction stroke is performed and continues until the first roller reaches the broadest region of the operating space (the minimum degree of deformation of a roller). The rollers cannot slide being in contact with the shaft and the off-centred housing. This condition is essential for limiting erosion on the contacting surface. The tangential force along the line of contact between the rollers and other surface is capable of significantly increasing the pressure drop between two sides of a roller: pressure in subsequent sealed chamber B will be greater than in sealed chamber A. The pressure multiplied by the roller surface area represents tangential force F1 that should be maintained along two lines of contacts (with the shaft and outer housing): they are forces F2 and F3. These forces are directed oppositely towards the pump delivery zone. One way to provide such action consists in use of a surface characterized by strong friction. External surface of a roller may be made of rubber. FIG. 5 shows another way to maintain the action exerted by tangential pressure. In this embodiment the roller body and two other surfaces are provided with axial grooves (here the effected interaction is similar to that in a gearing).

Thereafter the petroleum that entered this chamber, without a change in the sealed chamber volume, is displaced until the second roller reaches the broadest region in the operating space. As this occurs, the first roller takes the position whereat the sealed chamber communicates with the delivery port. Then movement of the rollers is accompanied by an increase of degree of their deformation and, accordingly, with a decrease of the sealed chamber volume, so that the previously extracted petroleum is delivered to the delivery port. Thus the delivery stroke is carried out and proceeds until the first roller reaches the narrowest place in the operating surface. This is followed by movement of the rollers with subsequent deformation of the first roller and an increase of deformation of the second roller, whereby the sealed chamber volume remains constant. After that the suction process begins, and the whole above-mentioned cycle is repeated.

The rotary pump according to this invention may have another number of areas including the suction and delivery regions. It is obvious that in such embodiment each one of the areas comprising the suction region will be provided with its suction port, and each one of the areas comprising the delivery region will be provided with the delivery port. In one embodiment, the suction port can be arranged on one end-surface of the pump, while the delivery port must be implemented on the other end-surface of the pump. In another embodiment, both types of the ports can be disposed on the same end-surface. Besides, the electric drive (motor) can be used instead of the hydraulic drive.

The previously described inventive pump can be suitably used not only for pumping of petroleum but for pumping other liquids, gases, or mixtures thereof as well.

FIG. 6 shows suction ports and/or delivery ports implemented in a respective housing end-face wall and/or housing side-wall of the housing 1. FIG. 7 shows a suction port and/or a delivery port implemented in the rotating shaft 3. FIG. 8 shows housing end-face walls integral with a detachable housing side wall of the housing 1. FIG. 9 shows at least one housing end-face detachably coupled to a housing side wall of the housing 1. FIG. 10 shows a roller 4 implemented in the form of a hollow rod made of a resilient material.

The embodiments set forth herein must not be considered as any limit to the invention claims. A person skilled in the art will appreciate that in the rotary pump described herein, many modifications are possible within the scope of the inventive principles stated in the invention claims.

The invention claimed is:

1. An assembly for a rotary pump, the assembly comprising:

a housing that comprises a side wall having an upper end and a lower end wherein a surface of the side wall defines in part a chamber having a longitudinal axis extending between the upper end to the lower end, a cross-sectional area at the upper end and a cross-sectional area at the lower end, and wherein the cross-sectional area at the upper end exceeds the cross-sectional area at the lower end;

a shaft having a longitudinal axis aligned with the longitudinal axis of the chamber, wherein the shaft comprises a surface that defines annuli with respect to the surface of the side wall of the housing, and wherein, at each position along the aligned longitudinal axes, each of the annuli comprises a minimum radial distance and a maximum radial distance; and deformable rollers disposed between the surface of the shaft and the surface of the side wall of the housing, each of the deformable rollers having a longitudinal axis disposed at an angle to the aligned longitudinal axes of the chamber and the shaft.

2. The assembly of claim 1 wherein cross-sections of the chamber comprise ellipses.

3. The assembly of claim 1 wherein the deformable rollers comprises truncated cones.

4. The assembly of claim 1 wherein the deformable rollers comprise cylinders.

5. The assembly of claim 1 wherein the shaft comprises a truncate cone.

6. The rotary pump of claim 1 wherein the shaft comprises a rotatable shaft.

7. The assembly of claim 1 wherein the side wall of the housing comprises a rotatable side wall.

8. The assembly of claim 1 wherein the deformable rollers comprise steel rods covered by a resilient material layer.

9. The assembly of claim 1 wherein adjacent pairs of the deformable rollers define cavities therebetween.

10. The assembly of claim 9 wherein deformation of the deformable rollers provides for formation of seals between the surface of the shaft and the surface of the side wall for sealing of fluid in each of the cavities.

11. The assembly of claim 1 wherein each of the deformable rollers comprises a resilient material reinforced by another material, wherein the other material comprises a material selected from a group consisting of glass fiber, carbon fiber and steel threads.

* * * * *